US010352119B2

(12) United States Patent
Doane et al.

(10) Patent No.: US 10,352,119 B2
(45) **Date of Patent: *Jul. 16, 2019**

(54) HYDROCARBON POWERED PACKER SETTING TOOL

(71) Applicant: BAKER HUGHES, A GE COMPANY, LLC, Houston, TX (US)

(72) Inventors: James C. Doane, Sugar Land, TX (US); Daniel C Ewing, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 297 days.

This patent is subject to a terminal disclaimer.

(21) Appl. No.: 15/340,426

(22) Filed: Nov. 1, 2016

(65) Prior Publication Data

US 2018/0119505 A1 May 3, 2018

(51) Int. Cl.
*E21B 23/06* (2006.01)

(52) U.S. Cl.
CPC ..... *E21B 23/065* (2013.01)

(58) Field of Classification Search
CPC ..... E21B 23/065
See application file for complete search history.

(56) References Cited

U.S. PATENT DOCUMENTS

| | | | | |
|---|---|---|---|---|
| 2,644,530 | A * | 7/1953 | Baker | E21B 23/065 166/63 |
| 3,982,591 | A * | 9/1976 | Hamrick | E21B 34/16 166/302 |
| 4,126,180 | A * | 11/1978 | Cha | E21B 43/247 166/259 |
| 7,591,319 | B2 | 9/2009 | Xu | |
| 2012/0125610 | A1 * | 5/2012 | Prentice, III | E21B 43/2406 166/272.3 |

* cited by examiner

*Primary Examiner* — Robert E Fuller
(74) *Attorney, Agent, or Firm* — Shawn Hunter

(57) ABSTRACT

A packer setting tool for setting a packer device within a wellbore. The packer setting tool includes an outer housing defining a piston chamber within. A piston member is disposed within the piston chamber and is moveable therein in response to ignition of a liquid hydrocarbon fuel source.

17 Claims, 5 Drawing Sheets

HYDROCARBON POWERED PACKER SETTING TOOL

BACKGROUND OF THE INVENTION

1. Field of the Invention

The invention relates generally to setting tools used to set packers or similar devices within a wellbore or other surrounding tubular.

2. Description of the Related Art

Packers are used to anchor or set an interior tubular string or tool within a surrounding outer tubular. Many packers are compression-set devices which have outer elements that are axially moved and compressed upon an inner mandrel to cause radial outward movement of the locking or sealing elements. Conventional packer setting tools rely upon a high explosive charge to set an associated packer device.

SUMMARY OF THE INVENTION

The invention provides a packer setting tool as well as methods for setting a packer within a wellbore. A work string includes a packer device and a packer setting tool in accordance with the present invention. In described embodiments, the packer device and packer setting tool are disposed into a wellbore using a wireline running string.

Exemplary packer setting tools are described which include an outer housing which defines a piston chamber within. A piston member is moveably disposed within the piston chamber. The piston member includes a prong portion which is shaped and sized to move a setting sleeve in an affixed cross-link tool and thereby effect setting of an affixed packer device. The piston member also preferably provides a radially enlarged piston head to receive setting pressure and cause the piston member to move axially within the piston chamber.

Setting pressure is generated by ignition of a liquid hydrocarbon power source within the setting tool. The liquid hydrocarbon power source container which includes an amount of liquid hydrocarbon fuel, such as gasoline, kerosene, mineral spirits or diesel. The liquid hydrocarbon fuel would have a high energy density, require minimal air to burn and have a high auto-ignition temperature.

In a first described embodiment, the container for the liquid hydrocarbon fuel includes an injection piston which is responsive to hydrostatic pressure as well as a fluid valve which controls flow of liquid hydrocarbon fuel into the piston chamber. Preferably, a nozzle is provided through which the fuel is dispersed and/or atomized into the piston chamber from the container. Preferably also, the packer setting tool includes a fan to assist in dispersal of fuel within the piston chamber. An ignition source, such as a spark plug, is located within the piston chamber and is used to ignite dispersed fuel within the piston chamber to move the piston member axially within the piston chamber. In operation, the setting tool is actuated by transmitting an electrical signal to open the fluid valve, actuate the fan and energize the spark plug.

In a second described embodiment, liquid hydrocarbon fuel is retained within a frangible container within the piston chamber. Ignition of the fuel will rupture the container and permit the resultant combustion gases to expand within the piston chamber and move the piston axially.

In preferred embodiments, the setting tool includes a mechanism for venting combustion gases from the setting tool. Lateral vents are formed within the prong portion of the piston member. As the piston member is moved axially within the piston chamber, a central mandrel is removed from a blind bore in the piston member, allowing gases to pass through the blind bore and lateral vent openings in the piston member.

The inventor has determined that use of a packer setting tool in accordance with the present invention affords a number of advantages. For example, transport of liquid hydrocarbons is less hazardous than transport of explosives.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
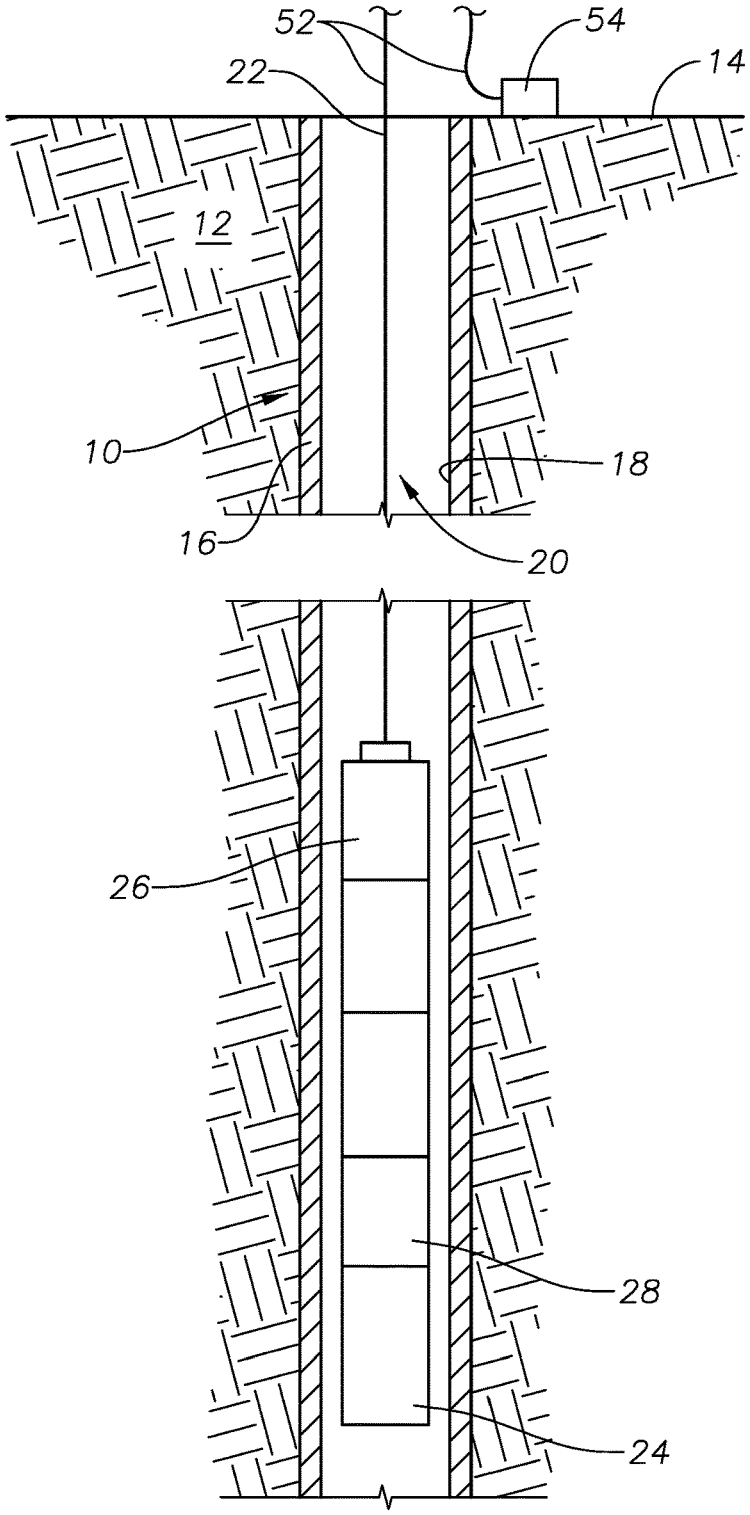
FIG. 1 is a side, cross-sectional view of an exemplary wellbore which contains a work string that includes a packer setting assembly constructed in accordance with the present invention.

FIG. 1 depicts an exemplary wellbore 10 which has been drilled through the earth 12 from the surface 14. In the depicted embodiment, the wellbore 10 is lined with casing 16 and presents a sidewall 18.

A work string 20 is being run into the wellbore 10 from the surface 14. The work string 20 includes a running string 22 and may carry a bottom hole assembly (not shown) or a variety of downhole tools or a type known in the art. In preferred embodiments, the running string 22 is wireline or a type known in the art. However, the running string 22 might also be made up of conventional tubular sections which are interconnected in an end-to-end fashion or be coiled tubing.

A compression-set packer device 24 and packer setting tool 26 are carried by the running string 22. The terms "packer" and "packer device," as used herein, are intended to refer broadly not only to devices which incorporate elastomeric packer elements but also those which include slips, locks, plugs and similar devices which are set to engage the surrounding wall of a wellbore or other tubular member. It should be understood that the compression-set nature of the packer device 24 will require a setting sleeve on an affixed cross-link tool 28 to actually set the packer device 24 within the wellbore 10.

Preferably, a cross-link tool 28 is disposed between the packer device 24 and the packer setting tool 26. A cross-link tool is a known device which converts axial forces generated by a setting tool to axial setting forces which are useful for setting a packer device. Suitable cross-link tools for use in this application include a cross-link sleeve used with the E-4 Baker Hughes setting tool.

Figure 2:
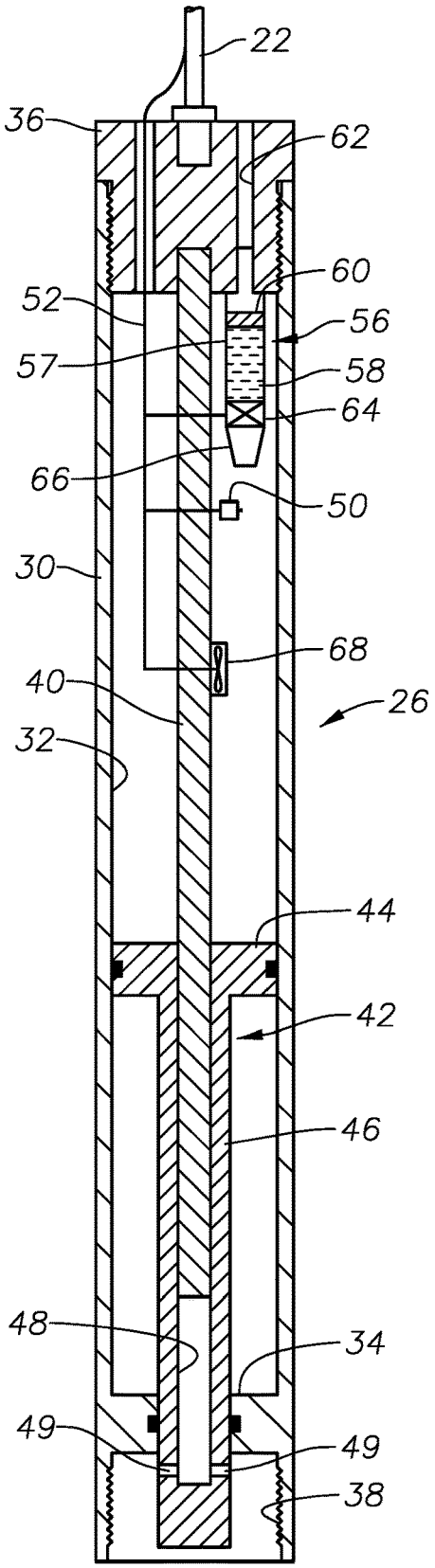
FIG. 2 is a side, cross-sectional view of an exemplary setting tool constructed in accordance with the present invention.
Figure 3:
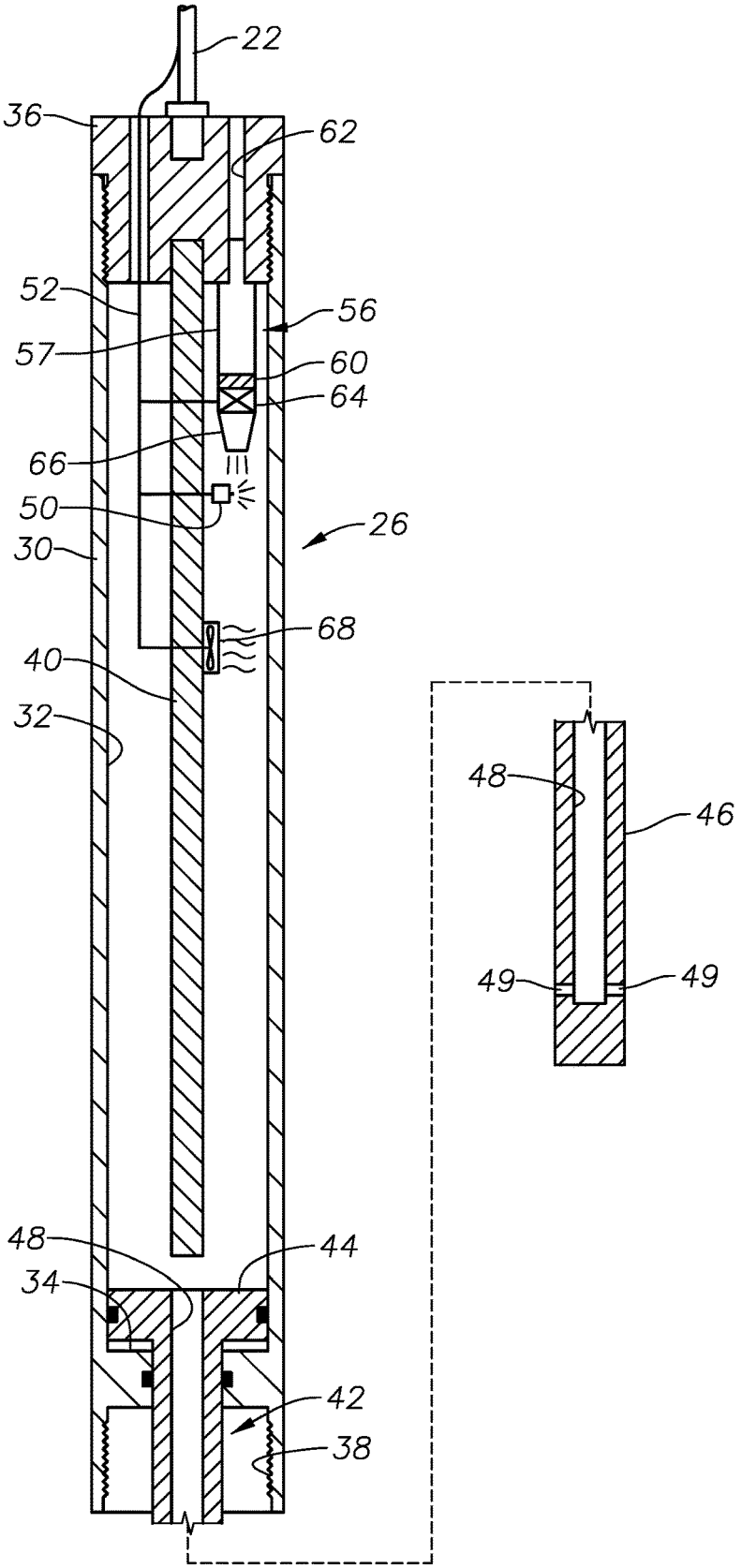
FIG. 3 is a side, cross-sectional view of the setting tool shown in FIG. 2, now having been actuated to set a packer device.

A first exemplary packer setting tool 26 is depicted in greater detail in FIGS. 2-3. In FIG. 2, the packer setting tool 26 is in a run-in configuration prior to actuation. The packer setting tool 26 features a generally cylindrical outer housing 30 which defines an interior piston chamber 32 along its length. The piston chamber 32 is enclosed at its axial ends by a lower bulkhead 34 and a top cap 36. A threaded box connector 38 is formed at the lower end of the outer housing 30 and is used to affix the packer setting tool 26 to the cross-link tool 28. Preferably, a central mandrel 40 extends downwardly from the top cap 36 into the piston chamber 32.

A piston member 42 is disposed within the piston chamber 32 and is axially moveable therein. The piston member 42 includes a radially enlarged piston head 44 and a prong portion 46 which extends axially downwardly from the piston head 44. A blind bore 48 is preferably formed through the piston head 44 and into the prong portion 46. The central mandrel 40 is disposed within the blind bore 48. It is noted that the prong portion 46 of the piston member 42 is shaped and sized to move a setting sleeve within the affixed cross-link tool 28, the setting sleeve designed to set the affixed packer device 24. Lateral vent openings 49 are formed within the prong portion 46 of the piston member 42. The lateral vent openings 49 allow fluid communication between the blind bore 48 and an area radially surrounding the prong portion 46. In the initial, run-in configuration shown in FIG. 2, fluid communication through the lateral vent openings 49 is blocked by the presence of the central mandrel 40 within the blind bore 48.

An ignition source in the form of a spark plug 50 is located within the piston chamber 32. The term "spark plug," as used herein, will refer to a pair of gapped electrodes which allow creation of a spark between the two electrodes when energized. In the depicted embodiment, the spark plug 50 is disposed upon the central mandrel 40. However, it may be placed in other locations within the piston chamber 32. The spark plug 50 is operably associated with electrical wiring 52, which extends along the wireline 22 to an electric power source 54 (such as a battery) at surface 14.

A liquid hydrocarbon power source 56 is affixed to the top cap 36 to retain hydrocarbon fluid amount 58 within a small volume and proximate the spark plug 50. The liquid hydrocarbon power source 56 preferably includes a container 57 which contains the amount 58 of liquid hydrocarbon fuel. An injection piston 60 is also slidably disposed within the container 57. The lower side of the injection piston 60 is in contact with the hydrocarbon fluid amount 58. The upper side of the injection piston 60 is exposed to hydrostatic pressure via a fluid passage 62 which passes through the top cap 36.

A valve 64 is located within the container 57 and controls flow of the hydrocarbon fluid amount 58 from the container 57 to the piston chamber 32. The valve 64 is closed during run-in, as shown in FIG. 2, so that the hydrocarbon fluid amount 58 is retained within the container 57. In preferred embodiments, the container 57 is provided with a nozzle 66 which is adapted to spray or disperse hydrocarbon fuel finely into the piston chamber 32. The valve 64 is controlled between open and closed positions by an electric signal provided by electric wiring 52.

In the depicted embodiment, a fan 68 is located within the piston chamber 32 and is used to disperse and atomize the fuel throughout the piston chamber 32 prior to/during ignition of the fuel. The fan 68 may be a brushless DC electric motor which rotates a blade or blades upon a spindle to generate air flow.

In preferred embodiments, the hydrocarbon fluid 58 is gasoline, kerosene, mineral spirits or diesel. The inventor has found that approximately 2.4 ml of gasoline can deliver 60,000 lbs. at 12" stroke and 50% efficiency. The inventor further estimates that 131 $in^3$ of air (in the piston chamber 32) at 150 psi would be sufficient for ignition of the hydrocarbon fluid 58.

In operation, the work string 20 is disposed into the wellbore 10 on wireline running string 22, as depicted in FIG. 1. When the packer device 24 is at a position within the wellbore 10 wherein it is desired to set the packer device, hydrostatic pressure will be transmitted via fluid passage 62 to the upper side of the injection piston 60, thereby pressurizing the hydrocarbon fluid amount 58. An electric signal is transmitted via electric wiring 52 and causes the valve 64 to open, and the hydrocarbon fluid amount 58 is dispersed into the piston chamber 32 through nozzle 66. Additionally, the electric signal will energize the fan 68 which will assist in dispersal of hydrocarbon fuel within the piston chamber 32.

The electric signal will also energize the spark plug 50 in contemporaneous fashion which causes ignition of the amount 58 of hydrocarbon fuel within the piston chamber 32. Ignition of the hydrocarbon fuel amount 58 will increase pressure within the piston chamber 32. Increased pressure within the piston chamber 32 acts upon the piston head 44 of the piston member 42 so that the prong portion 46 will set the packer device 24.

As the piston member 42 is moved fully downwardly, as depicted in FIG. 3, the central mandrel 40 is removed from the blind bore 48. As a result, combustion gases within the piston chamber 32 can exit the piston chamber 32 via the blind bore 48 and lateral vent openings 49.

Figure 4:
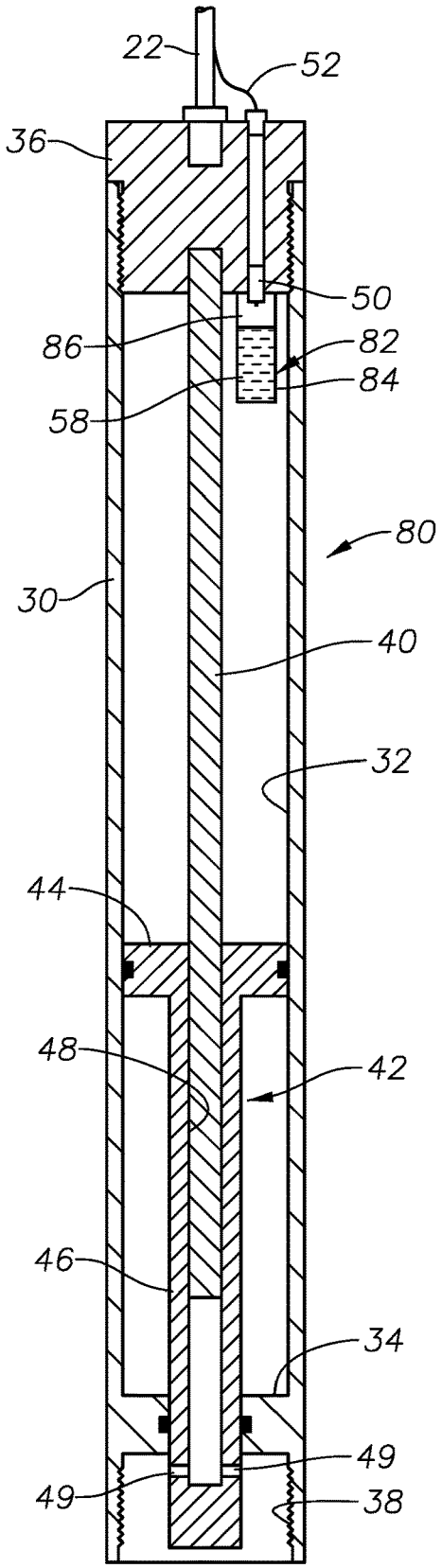
FIG. 4 is a side, cross-sectional view of an alternative embodiment for a setting tool constructed in accordance with the present invention.
Figure 5:
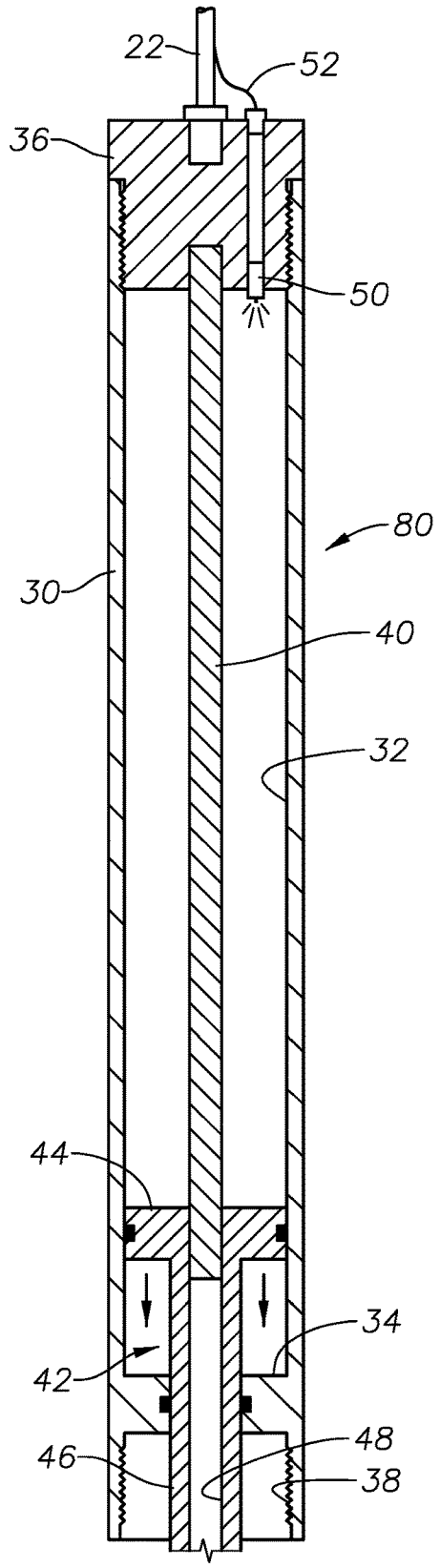
FIG. 5 is a side, cross-sectional view of the setting tool shown in FIG. 4, now being actuated to set a packer device.

FIG. 4-5 illustrate an alternative embodiment for a packer setting tool which uses liquid hydrocarbon fuel as a motive force for setting a packer device. Packer setting tool 80 is constructed in and operates in the same manner as the packer setting tool 26 described earlier, except where noted otherwise. In packer setting tool 80, the spark plug 50 is retained within top cap 36. A liquid hydrocarbon power source 82 includes a frangible container 84 which is affixed to the top cap 36 as well so that the hydrocarbon fluid amount 58 is retained in proximity to the spark plug 50. The frangible container 84 is intended to rupture and break away during ignition of the hydrocarbon fluid amount 58. The frangible container 84 could also comprise a tube with a rupture disc on one end so that when the hydrocarbon is ignited, the pressure generated ruptures the disc and flows into the piston chamber 32. Preferably, an air gap 86 is maintained within the container 56 between the hydrocarbon fluid amount 58 and the spark plug 50. The air gap 86 ensures that the spark plug 50 can create a spark.

In operation, the packer setting tool 80 is disposed into the wellbore 10 is initiated to set a packer device 24 by transmitting an electrical signal via electrical wiring 52 to energize spark plug 50 and ignite the hydrocarbon fluid amount 58. In alternative embodiments, the electrical signal could be provided from a self-contained energy source built into the packer setting tool 80 (e.g., a battery) rather than from wireline. The packer setting tool 80 could have a built in controller. The frangible container 56 will rupture allowing the resulting combustion gases to disperse throughout the piston chamber 32 and urge the piston member 44 downwardly.

Those of skill in the art will recognize that numerous modifications and changes may be made to the exemplary designs and embodiments described herein and that the invention is limited only by the claims that follow and any equivalents thereof.

What is claimed is:

1. A packer setting tool for setting a packer device within a wellbore, the packer setting tool comprising:

an outer housing which defines a piston chamber within;

a piston member moveably disposed within the piston chamber, the piston member being effective to set the packer device when the piston member is moved axially within the piston chamber;

a liquid hydrocarbon source disposed within the piston chamber, ignition of the liquid hydrocarbon source within the piston chamber being effective to move the piston member within the piston chamber to set the packer device;

wherein the liquid hydrocarbon source comprises:

a container disposed within the piston chamber, an amount of liquid hydrocarbon fuel retained within the container, an injection piston for dispersing the liquid hydrocarbon fuel from the container into the piston chamber; and wherein an ignition source ignites the dispersed liquid hydrocarbon fuel within the piston chamber.

2. The packer setting tool of claim 1 further comprising an ignition source for the liquid hydrocarbon source, the ignition source being located within the piston chamber.

3. The packer setting tool of claim 2 wherein the ignition source comprises a spark plug.

4. The packer setting tool of claim 2 wherein the ignition source is energized by a power source which is at a surface location.

5. The packer setting tool of claim 1 further comprising a fan disposed within the piston chamber to assist dispersal of the liquid hydrocarbon fuel.

6. The packer setting tool of claim 1 wherein the liquid hydrocarbon source further comprises:

a frangible container; and an amount of liquid hydrocarbon fuel within the container.

7. The packer setting tool of claim 1 wherein the liquid hydrocarbon fuel comprises gasoline, kerosene, mineral spirits or diesel.

8. The packer setting tool of claim 1 further comprising:

a central mandrel fixedly disposed within the piston chamber;

a blind bore formed within the piston member;

a lateral vent opening disposed through the piston member to permit fluid communication between the blind bore and an area radially surrounding the piston member; and wherein the central mandrel is disposed within the blind bore to block fluid communication through the lateral vent opening, the central mandrel further being removed from the blind bore as the piston member is moved axially within the piston chamber to unblock fluid flow through the lateral vent opening.

9. A packer setting tool for setting a packer device within a wellbore, the packer setting tool comprising:

an outer housing which defines a piston chamber within;

a piston member moveably disposed within the piston chamber, the piston member being effective to set the packer device when the piston member is moved axially within the piston chamber;

a liquid hydrocarbon source, ignition of which being effective to move the piston member within the piston chamber to set the packer device;

an ignition source for the liquid hydrocarbon source;

wherein the liquid hydrocarbon source comprises a container disposed within the piston chamber, an amount of liquid hydrocarbon fuel retained within the container, an injection piston for dispersing the liquid hydrocarbon fuel from the container into the piston chamber; and wherein the ignition source ignites the dispersed liquid hydrocarbon fuel within the piston chamber.

10. The packer setting tool of claim 9 wherein the ignition source comprises a spark plug.

11. The packer setting tool of claim 9 further comprising a fan disposed within the piston chamber to assist dispersal of the liquid hydrocarbon fuel.

12. The packer setting tool of claim 9 wherein the liquid hydrocarbon source further comprises:

a frangible container; and an amount of liquid hydrocarbon fuel within the container.

13. The packer setting tool of claim 9 wherein the liquid hydrocarbon fuel comprises gasoline, kerosene, mineral spirits or diesel.

14. The packer setting tool of claim 9 further comprising:

a central mandrel fixedly disposed within the piston chamber;

a blind bore formed within the piston member;

a lateral vent opening disposed through the piston member to permit fluid communication between the blind bore and an area radially surrounding the piston member; and wherein the central mandrel is disposed within the blind bore to block fluid communication through the lateral vent opening, the central mandrel further being removed from the blind bore as the piston member is moved axially within the piston chamber to unblock fluid flow through the lateral vent opening.

15. The packer setting tool of claim 9 wherein the ignition source is energized by a power source.

16. A method of setting a packer device within a wellbore, the method comprising the steps of:

disposing into a wellbore a packer device and a packer setting device, the packer packer setting device having a piston chamber and a piston member axially moveable within the piston chamber;

igniting an amount of liquid hydrocarbon fuel within the piston chamber of the packer setting device to move the piston member within the piston chamber and set the packer device; and wherein the amount of liquid hydrocarbon fuel is ignited by moving an injection piston to disperse the liquid hydrocarbon fuel from a container into the piston chamber.

17. The method of claim 16 wherein the amount of liquid hydrocarbon fuel is further ignited by sparking a spark plug.

* * * * *